US009875707B2

(12) United States Patent
Cheng et al.

(10) Patent No.: US 9,875,707 B2
(45) Date of Patent: Jan. 23, 2018

(54) DISPLAY APPARATUS AND GATE DRIVING METHOD THEREOF

(71) Applicant: Novatek Microelectronics Corp., Hsinchu (TW)

(72) Inventors: Jhih-Siou Cheng, New Taipei (TW); Po-Hsiang Fang, Hsinchu (TW); Po-Yu Tseng, Taoyuan (TW); Chieh-An Lin, Taipei (TW); Ju-Lin Huang, Hsinchu County (TW); Yi-Chuan Liu, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 371 days.

(21) Appl. No.: 14/708,303

(22) Filed: May 11, 2015

(65) Prior Publication Data

US 2016/0335970 A1 Nov. 17, 2016

(51) Int. Cl.
*G09G 3/36* (2006.01)

(52) U.S. Cl.
CPC ..... *G09G 3/3674* (2013.01); *G09G 3/3648* (2013.01); *G09G 2310/0213* (2013.01); *G09G 2310/067* (2013.01); *G09G 2320/041* (2013.01); *G09G 2330/025* (2013.01)

(58) Field of Classification Search
CPC ..... G09G 3/3674; G09G 3/3648; G09G 2330/025; G09G 2310/067; G09G 2320/041; G09G 2310/0213
See application file for complete search history.

(56) References Cited

U.S. PATENT DOCUMENTS

| | | | | |
|---|---|---|---|---|
| 5,552,802 | A * | 9/1996 | Nonoshita | G09G 3/3629 345/100 |
| 6,469,684 | B1 * | 10/2002 | Cole | G09G 3/3614 345/58 |
| 8,624,816 | B2 * | 1/2014 | Ryu | G09G 3/3688 345/100 |
| 8,803,787 | B2 * | 8/2014 | Kojima | G09G 3/3406 345/102 |
| 9,099,023 | B2 * | 8/2015 | Baek | G09G 3/006 |
| 2009/0073343 | A1 | 3/2009 | Kojima et al. | |
| 2010/0013817 | A1 | 1/2010 | Ryu et al. | |
| 2011/0310068 | A1 | 12/2011 | Nose et al. | |
| 2012/0146965 | A1 | 6/2012 | Baek et al. | |
| 2014/0225877 | A1 * | 8/2014 | Nakanishi | G09G 3/3648 345/204 |

FOREIGN PATENT DOCUMENTS

| | | |
|---|---|---|
| CN | 102542971 | 7/2012 |
| TW | 200931383 | 7/2009 |
| TW | 201007687 | 2/2010 |
| TW | 201232101 | 8/2012 |
| TW | 201351392 | 12/2013 |

OTHER PUBLICATIONS

"Office Action of Taiwan Counterpart Application", dated Mar. 21, 2016, p. 1-p. 6.

* cited by examiner

*Primary Examiner* — Andrew Sasinowski
(74) *Attorney, Agent, or Firm* — JCIPRNET

(57) ABSTRACT

A display apparatus and a gate driving method thereof are provided. The display apparatus includes a display panel and a gate driver. The display panel has a plurality of gate lines. Output terminals of the gate driver are coupled to the gate lines in a one-to-one manner. The gate driver is configured to drive the gate lines according to a scrambled scan sequence.

18 Claims, 5 Drawing Sheets

DISPLAY APPARATUS AND GATE DRIVING METHOD THEREOF

BACKGROUND

Technical Field

The invention relates to an electronic device, and particularly relates to a display apparatus and a gate driving method thereof.

Related Art

FIG. 1 is a conventional driving timing schematic diagram of a thin film transistor (TFT) liquid crystal display (LCD). The conventional LCD includes a display panel 100. The display panel 100 is composed of two substrates, and a liquid crystal material is filled there between to form an LCD layer. The display panel 100 is configured with a plurality of source lines (or referred to as data lines, for example, source lines S(1), S(2), S(3), . . . , S(n−1) and S(n) shown in FIG. 1), a plurality of gate lines (or referred to as scan lines, for example, gate lines G(1), G(2), G(3), G(4) . . . , G(m) shown in FIG. 1), and a plurality of pixel units (for example, pixel units P(1,1), P(1,2), P(1,*n*−1), P(2,1), P(2,2), P(2,*n*−1), P(3,1), P(3,2), P(3,*n*−1), P(m,1), P(m,2) and P(m,n−1) shown in FIG. 1). The source lines S(1)-S(n) are perpendicular to the gate lines G(1)-G(m). The pixel units P(1,1)-P(m,n−1) are arranged on the display panel 100 in an array. In FIG. 1, an exemplary circuit diagram of the pixel unit P(m,n−1) is illustrated, and other pixel units can be deduced with reference of the pixel unit P(m,n−1).

In the conventional LCD, the gate lines of the LCD panel are generally scanned in a fixed sequence. A gate driver (not shown) can output scan signals to the gate lines G(1)-G(m) of the display panel 100, so as to drive the gate lines G(1)-G(m) one-by-one in turns in a fixed sequence. Generally, the gate line G(1) is first driven, and then the gate lines G(2), G(3), . . . etc., are sequentially driven. In collaboration with a scan timing of the gate driver (not shown) on the gate lines G(1)-G(m), a source driver (not shown) can write source driving signals to the pixel units (for example, the pixel units P(1,1), P(1,2), P(1,*n*−1), P(2,1), P(2,2), P(2,*n*−1), P(3,1), P(3,2), P(3,*n*−1), P(m,1), P(m,2) and P(m,n−1) shown in FIG. 1) of the display panel 100 through the source lines S(1)-S(n) to display an image.

When the conventional LCD displays a specific display pattern, the source driver (not shown) probably consumes a lot of power or even produces a high temperature due to that the source driver frequently and dramatically changes the source driving signals. FIG. 2 is a signal waveform diagram of the LCD of FIG. 1 in a certain specific display pattern. A horizontal axis in FIG. 2 represents time, Vcom represents a common voltage. It is assumed that the aforementioned specific display pattern is that "gray levels of pixel units in odd rows are 0, and gray levels of pixel units in even rows are 255". For example, the gray levels of the pixel units P(1,1)-P(1,*n*−1) of a first row and the pixel units P(3,1)-P(3,*n*−1) of a third row are 0, and the gray levels of the pixel units P(2,1)-P(2,*n*−1) of a second row are 255. When the specific display pattern is displayed, as shown in FIG. 2, the source driving signals of the source lines S(1)-S(n) are frequently and dramatically changed, such that the source driver (not shown) probably consumes a lot of power or even produces a high temperature.

According to the driving method of the conventional gate driver (not shown), a fixed sequence is adopted to scan the gate lines of the LCD panel. The driving method of the fixed sequence must have one or a plurality of specific display patterns, such that the source driver (not shown) is liable to have a large power consumption. Under the driving method of the fixed sequence, if the specific display pattern is regularly appeared, the temperature of the source driver (not shown) can be excessively high to cause abnormal image display.

SUMMARY

The invention is directed to a display apparatus and a gate driving method thereof, by which a driving circuit of a display panel is avoided to regularly operate in a large power output.

An embodiment of the invention provides a display apparatus including a display panel and a gate driver. The display panel has a plurality of gate lines. Output terminals of the gate driver are coupled to the gate lines in a one-to-one manner. The gate driver is configured to drive the gate lines according to a scrambled scan sequence.

An embodiment of the invention provides a gate driving method adopted in a display apparatus. The gate driving method includes providing a display panel; and driving a plurality of gate lines of the display panel by a gate driver according to a scrambled scan sequence.

According to the above descriptions, according to the display apparatus and the gate driving method thereof, the scrambled scan sequence is used to drive the gate lines of the display panel. Therefore, the driving circuit of the display panel is avoided to regularly operate in a large power output.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
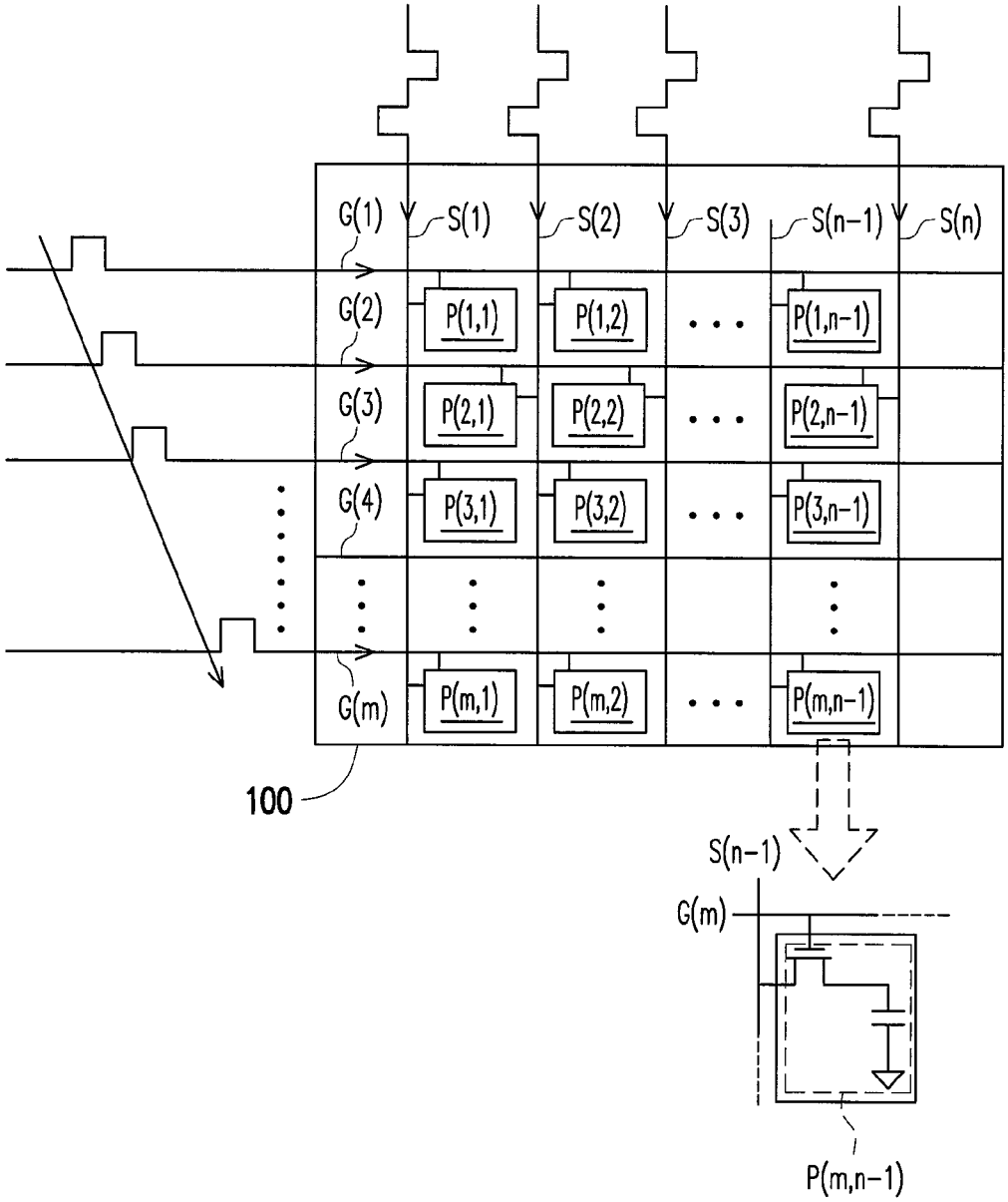
FIG. 1 (Related Art)
FIG. 1 is a conventional driving timing schematic diagram of a thin film transistor (TFT) liquid crystal display (LCD).

A term "couple" used in the full text of the disclosure (including the claims) refers to any direct and indirect connections. For example, if a first device is described to be coupled to a second device, it is interpreted as that the first device is directly coupled to the second device, or the first device is indirectly coupled to the second device through other devices or connection means. Moreover, wherever possible, components/members/steps using the same referential numbers in the drawings and description refer to the same or like parts. Components/members/steps using the same referential numbers or using the same terms in different embodiments may cross-refer related descriptions.

Figure 3:
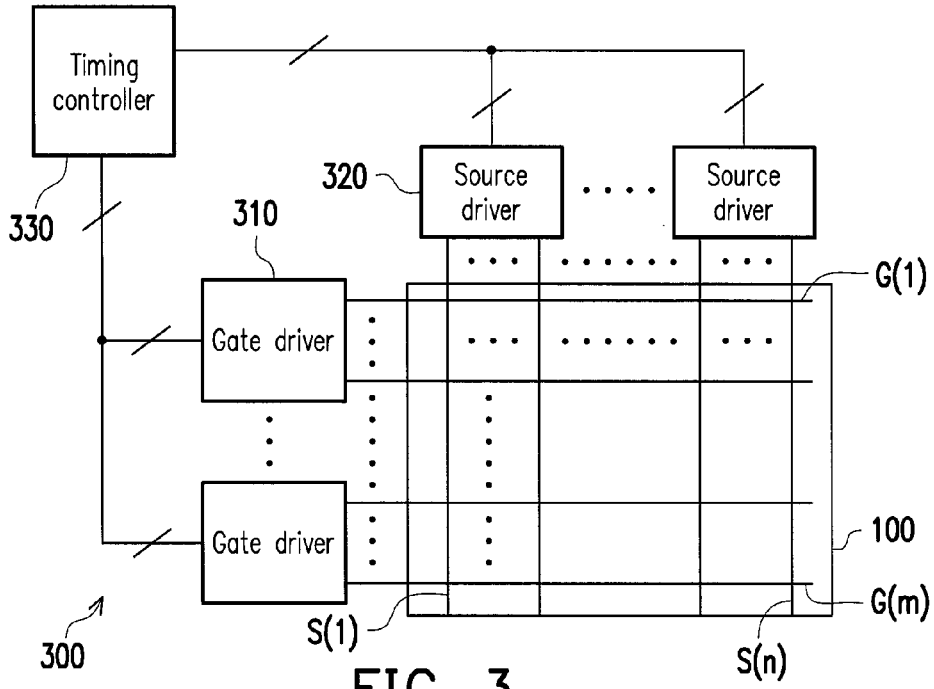
FIG. 3 is a circuit block schematic diagram of a display apparatus according to an embodiment of the invention.

FIG. 3 is a circuit block schematic diagram of a display apparatus 300 according to an embodiment of the invention. The display apparatus 300 includes a display panel 100, one or a plurality of gate drivers 310, one or a plurality of source drivers 320 and a timing controller 330. The display panel 100 has a plurality of gate lines (for example, gate lines G(1) and G(m) shown in FIG. 3 and a plurality of source lines (for example, source lines S(1) and S(n) shown in FIG. 3), where m and n are integers. The display panel 100 of FIG. 3 may refer to related description of the display panel 100 of FIG. 1, and details thereof are not repeated.

The gate drivers 310 are coupled between the timing controller 330 and the display panel 100. A plurality of output terminals of the gate drivers 310 are coupled to the gate lines of the display panel 100 in a one-to-one manner. After the gate drivers 310 receive a vertical start signal provided by the timing controller 330, the gate drivers 310 drive the gate lines of the display panel 100 according to a scrambled scan sequence. The source drivers 320 are coupled between the timing controller 330 and the display panel 100. In collaboration with the scrambled scan sequence of the gate drivers 310, the timing controller 330 can output corresponding line data (display data, image data) to the source drivers 320. The source drivers 320 convert the received image data into source driving signals, and drive the source lines S(1)-S(n) of the display panel 100 through the source driving signals. Under control of a source clock signal and a horizontal start signal outputted by the timing controller 330, the source drivers 320 can write the source driving signals into different pixel units of the display panel 100 in collaboration with scan timing of the gate drivers 310, so as to display an image.

Figure 4:
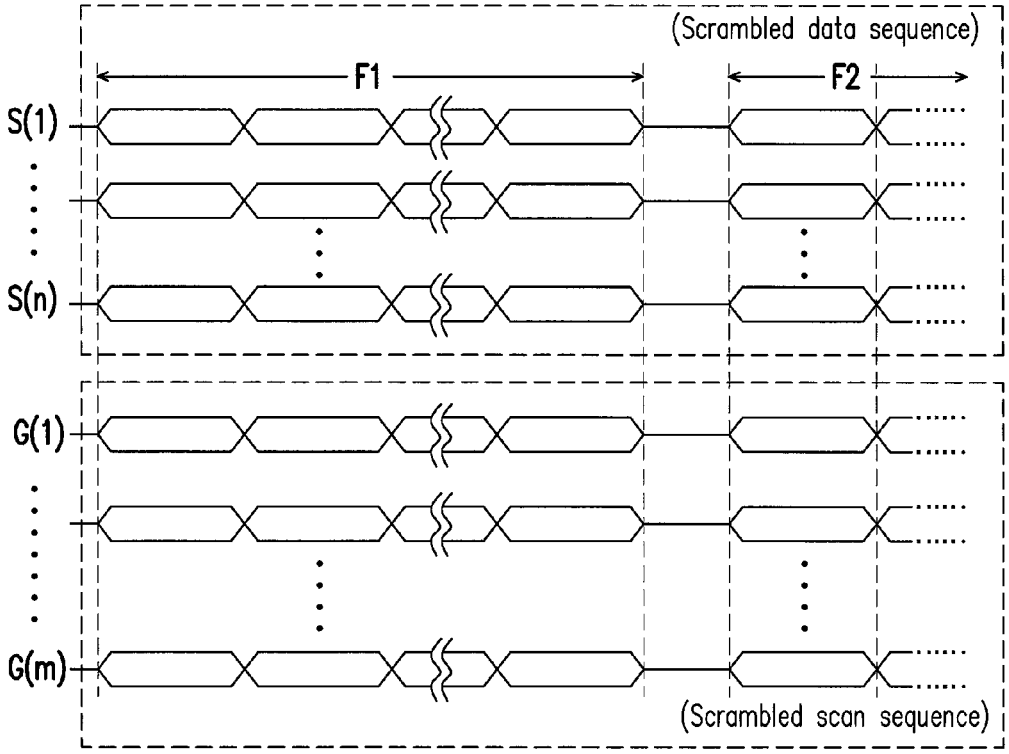
FIG. 4 is a signal timing schematic diagram of the circuit shown in FIG. 3 according to an embodiment of the invention.

For example, the gate drivers 310 can randomly select the gate lines G(1)-G(m) to decide a scan sequence of the gate lines to drive the display panel 100. FIG. 4 is a signal timing schematic diagram of the circuit shown in FIG. 3 according to an embodiment of the invention. In FIG. 4, a horizontal axis represent time. Referring to FIG. 3 and FIG. 4, the gate drivers 310 drive the gate lines G(1)-G(m) of the display panel 100 according to a scrambled scan sequence. In collaboration with the scrambled scan sequence of the gate drivers 310, the source drivers 320 can use a scrambled data sequence to output the corresponding source driving signals to the source lines S(1)-S(n).

In some embodiments, the gate drivers 310 can use a pseudo-random binary sequence (PRBS) to determine the scrambled scan sequence, so as to randomly select the gate lines G(1)-G(m). Implementation of the PRBS is not limited by the invention. In some embodiments, the PRBS can be produced/decided by a conventional PRBS circuit. In some embodiment, the gate drivers 310 includes a random number table. The gate drivers 310 can determine the scrambled scan sequence according to the random number table, so as to randomly select the gate lines G(1)-G(m).

In some embodiments, the gate drivers 310 may use different PRBSs to drive the gate lines G(1)-G(m) of the display panel 100 in different frames, so as to reduce a chance that the source drivers 320 are operated in a large power output. For example, the gate drivers 310 can use a first PRBS to decide the scrambled scan sequence of a first frame period (for example, a front frame F1), so as to drive the gate lines G(1)-G(m) of the display panel 100. The gate drivers 310 can also use a second PRBS different to the first PRBS to decide the scrambled scan sequence of a second frame period (for example, a rear frame F2), so as to drive the gate lines G(1)-G(m) of the display panel 100. Therefore, the scan sequence of the gate lines G(1)-G(m) for the front frame F1 can be different to the scan sequence of the gate lines G(1)-G(m) for the rear frame F2.

Figure 5:
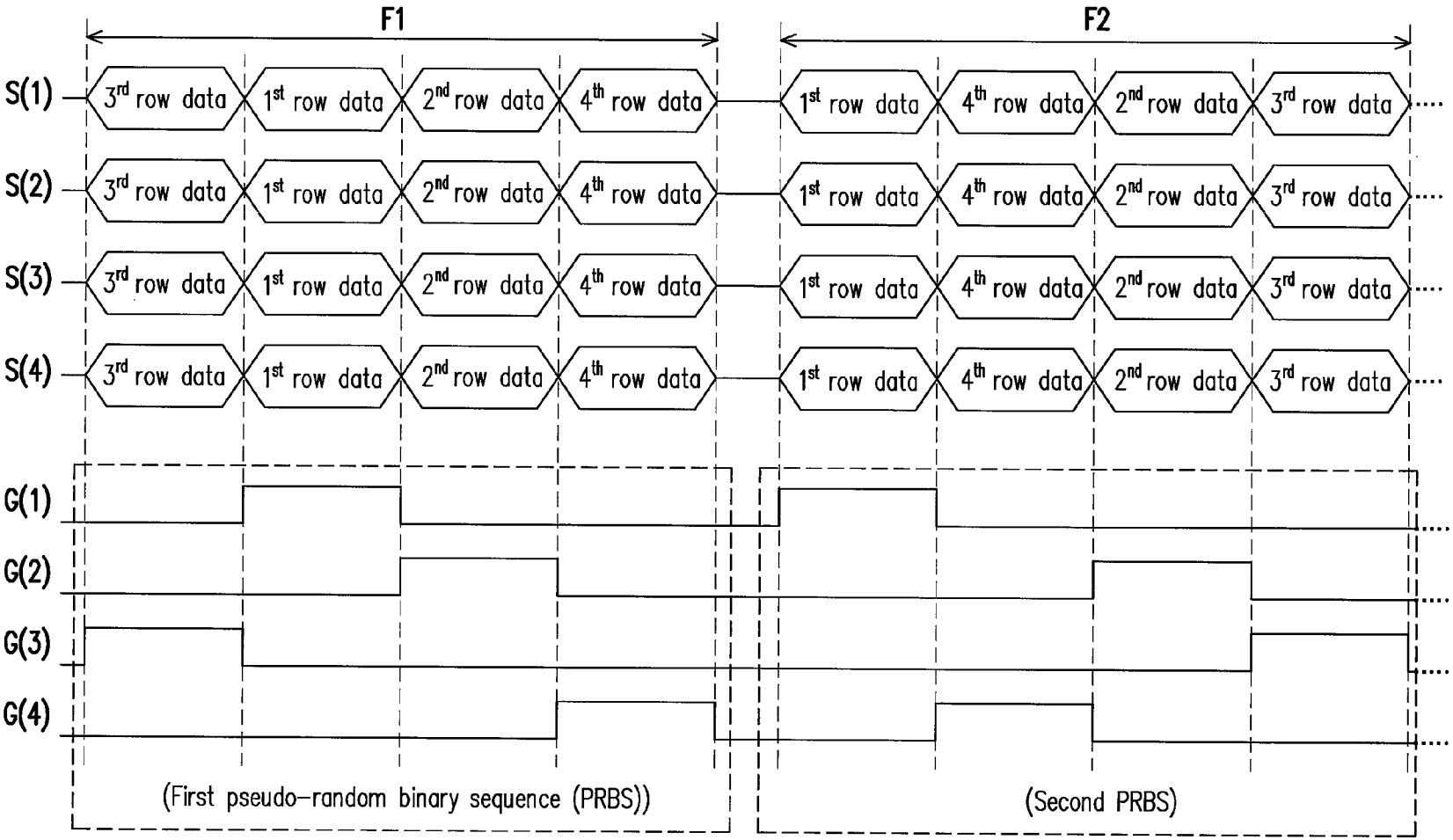
FIG. 5 is a signal timing schematic diagram of the circuit shown in FIG. 3 according to an application example.

For example, FIG. 5 is a signal timing schematic diagram of the circuit shown in FIG. 3 according to an application example. In FIG. 5, a horizontal axis represents time. In the application example of FIG. 5, it is assumed that the number m of the gate lines G(1)-G(m) shown in FIG. 3 is 4, and the number n of the source lines S(1)-S(n) is 4. Referring to FIG. 3 and FIG. 5, the scrambled scan sequence of the gate driver 310 for the gate lines G(1)-G(4) in the front frame F1 can be 3, 1, 2, 4, and the scrambled scan sequence of the gate driver 310 for the gate lines G(1)-G(4) in the rear frame F2 can be 1, 4, 2, 3. The gate drivers 310 drive the gate lines G(1)-G(4) of the display panel 100 according to the scrambled scan sequence. In collaboration with the scrambled scan sequence of the gate drivers 310, the source drivers 320 can use a scrambled data sequence to output the corresponding source driving signals to the source lines S(1)-S(4), as shown in FIG. 5. The gate lines of the display panel 100 are driven according to the scrambled scan sequence, so that the driving circuit of the display panel 100 is avoided to regularly operate in a large power output.

In some other embodiments, the gate drivers 310 may include a first random number table and a second random number table. The gate drivers 310 may use the first random number table to decide the scrambled scan sequence of the first frame period (for example, the front frame F1), and the gate drivers 310 may use the second random number table different to the first random number table to decide the scrambled scan sequence of the second frame period (for example, the rear frame F2).

In any circumstances, implementation of the gate driving method of the display apparatus 300 is not limited to FIG. 5. In some embodiments, the gate lines G(1)-G(m) can be categorized into a plurality of gate line groups GG(1)-GG(k), where k is an integer. The number of the gate lines included in each of the gate line groups can be different. Different gate line groups may have different scan sequences, so as to reduce a chance that the source drivers 320 operate in the large power output. For example, in some embodiments, the gate drivers 310 can use one PRBS to arrange a selection sequence of the gate line groups GG(1)-GG(k), and use different PRBSs to drive the gate lines G(1)-G(m) in different selected gate line groups, so as to reduce the chance that the source drivers 320 operate in the large power output. Implementation of the PRBS is not limited by the present embodiment. In some embodiments, different PRBSs can be determined by using different conventional PRBS circuit.

Figure 6:
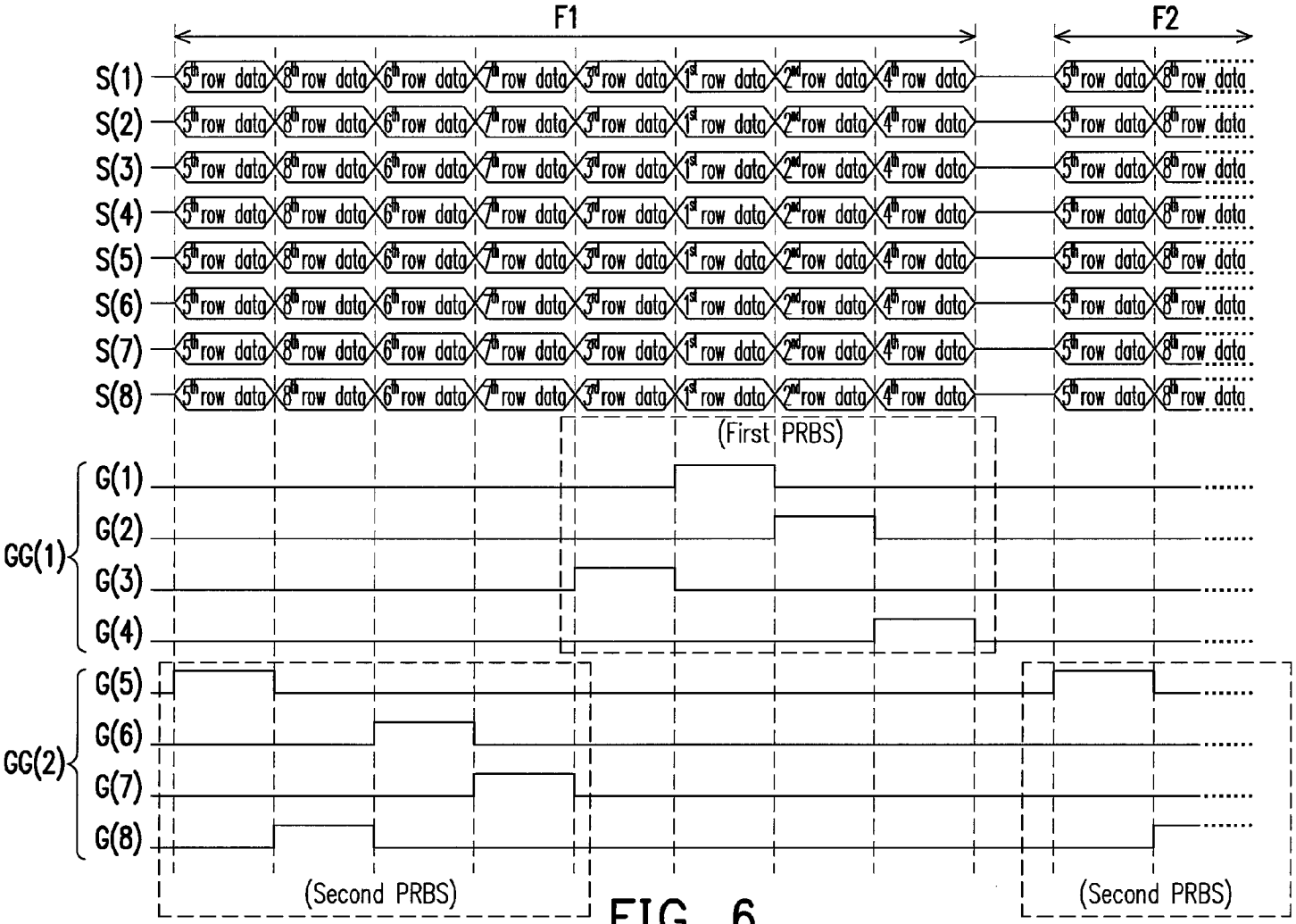
FIG. 6 is a signal timing schematic diagram of the circuit shown in FIG. 3 according to another application example.

For example, FIG. 6 is a signal timing schematic diagram of the circuit shown in FIG. 3 according to another application example. In FIG. 6, a horizontal axis represents time. In the application example of FIG. 6, it is assumed that the number m of the gate lines G(1)-G(m) shown in FIG. 3 is 8, and the number n of the source lines S(1)-S(n) is 8. Referring to FIG. 3 and FIG. 6, for example (but is not limited thereto), the gate lines G(1)-G(8) can be categorized into a first gate line group GG(1) and a second gate line group GG(2), where the first gate line group GG(1) includes the gate lines G(1), G(2), G(3) and G(4), and the second gate line group GG(2) includes the gate lines G(5), G(6), G(7) and G(8). The scan sequence for the gate lines of the first gate line group GG(1) can be different to the scan sequence for the gate lines of the second gate line group GG(2). For example (but is not limited thereto), the gate drivers 310 may use one PRBS to arrange a selection sequence of the gate line groups as GG(2) and GG(1), as shown in FIG. 6. The gate drivers 310 may use a second PRBS to decide the scrambled scan sequence of the second gate line group GG(2), where the second PRBS can be 1, 4, 2, 3 (i.e. G(5), G(8), G(6), G(7)) or other sequence. The gate drivers 310 may use a first PRBS different to the second PRBS to decide the scrambled scan sequence of the first gate line group GG(1), where the first PRBS can be 3, 1, 2, 4 (i.e. G(3), G(1), G(2), G(4)) or other sequence. The scrambled scan sequence of the rear frame F2 may refer to related description of the front frame F1, as shown in FIG. 6. Since different gate line groups use different scrambled scan sequences in different frames, the chance that the source drivers 320 operate in the large power output is effectively decreased.

In some other embodiments, the gate drivers 310 may include a first random number table and a second random number table. The gate drivers 310 may use the first random number table to decide the scrambled scan sequence of the first gate line group GG(1), and the gate drivers 310 may use the second random number table different to the first random number table to decide the scrambled scan sequence of the second gate line group GG(2).

Figure 2:
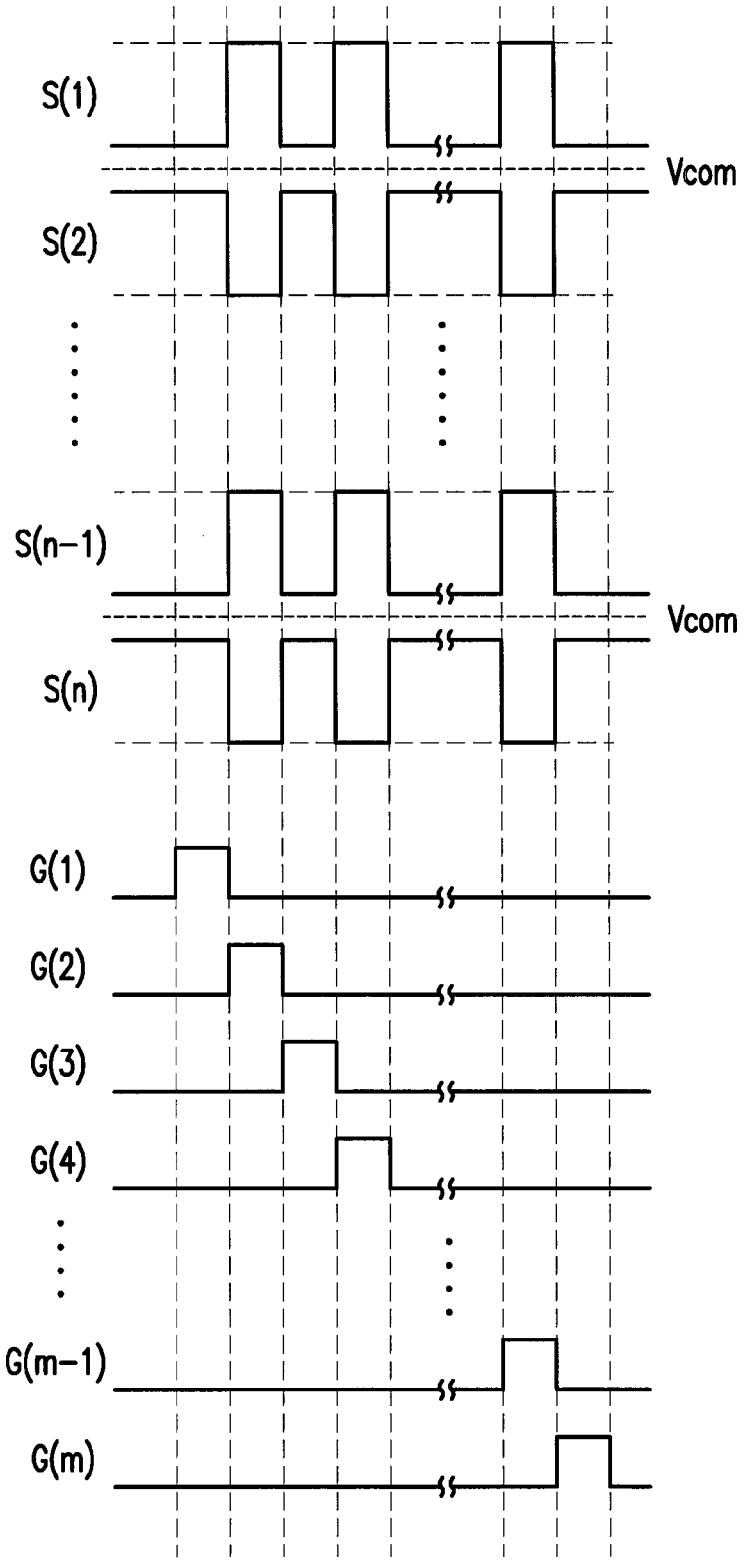
FIG. 2 (Related Art)
FIG. 2 is a signal waveform diagram of the LCD of FIG. 1 in a certain specific display pattern.

In some other embodiments, the timing controller 330 can detect image data of one frame period to obtain a detection result. According to the detection result, the timing controller 330 can control the gate drivers 310 to select one of a "non-scrambled scan sequence" and the "scrambled scan sequence" to drive the gate lines G(1)-G(m). The "non-scrambled scan sequence" can be the scan sequence shown in FIG. 2 or other conventional scan sequence. The "scrambled scan sequence" can be the scan sequence shown in FIG. 4, FIG. 5 or FIG. 6. For example, when the detection result indicates that the image data is complied with a specific display pattern, the timing controller 330 can control the gate drivers 310 to select the "scrambled scan sequence" to drive the gate lines G(1)-G(m). The "specific display pattern" may refer to related description of FIG. 2, and detail thereof is not repeated. When the detection result indicates that the image data is not complied with the specific display pattern, the timing controller 330 can control the gate drivers 310 to select the "non-scrambled scan sequence" to drive the gate lines G(1)-G(m).

In some embodiments, a thermal detector (not shown) can be configured in at least one of the source drivers 320, or configured nearby the source drivers 320 to detect a temperature of the source drivers 320. The thermal detector (not shown) reports a detecting result to the timing controller 330 and/or the gate drivers 310, so as to change the scan sequence for cooling down. Therefore, the timing controller 330 and/or the gate drivers 310 can get to learn the temperature of the source drivers 320. When the temperature of the source drivers 320 is higher than a certain high-temperature range, the gate drivers 310 can select the "scrambled scan sequence" to drive the gate lines G(1)-G(m), so as to change the scan sequence for cooling down. When the temperature of the source drivers 320 is lower than a certain low-temperature range, the gate drivers 310 can select the "non-scrambled scan sequence" to drive the gate lines G(1)-G(m). The "high-temperature range" and the "low-temperature range" can be determined according to an actual design requirement.

In some other embodiments, the source drivers 320 can detect power consumption of the source drivers 320 themselves. The source drivers 320 can report detecting result to the timing controller 330 and/or the gate drivers 310, so as to change the scan sequence to decrease the power consumption. Therefore, the timing controller 330 and/or the gate drivers 310 can get to learn the power consumption of the source drivers 320. When the power consumption of the source drivers 320 is higher than a certain high-power range, the gate drivers 310 can select the "scrambled scan sequence" to drive the gate lines G(1)-G(m), so as to change the scan sequence to decrease the power consumption. When the power consumption of the source drivers 320 is lower than a certain low-power range, the gate drivers 310 can select the "non-scrambled scan sequence" to drive the gate lines G(1)-G(m). The "high-power range" and the "low-power range" can be determined according to an actual design requirement.

In summary, the display apparatus and the gate driving method thereof disclosed by the embodiments of the invention can scramble the scan sequence of the gate lines G(1)-G(m). By scrambling the scan sequence of the gate lines G(1)-G(m), a chance that the source drivers 320 operate in a large power output is effectively decreased.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A display apparatus comprising:

a display panel having a plurality of gate lines; and a gate driver, having a plurality of output terminals coupled to the gate lines in a one-to-one manner, configured to drive the gate lines according to a scrambled scan sequence, wherein the gate driver is configured to determine the scrambled scan sequence in a first frame period according to a first pseudo-random binary sequence, and the gate driver is configured to determine the scrambled scan sequence in a second frame period according to a second pseudo-random binary sequence different from the first pseudo-random binary sequence.

2. The display apparatus as recited in claim 1, wherein the gate driver is configured to determine the scrambled scan sequence according to a pseudo-random binary sequence.

3. The display apparatus as recited in claim 1, wherein the gate lines are at least categorized into a first gate line group and a second gate line group, the gate driver is configured to determine the scrambled scan sequence of the first gate line group according to a first pseudo-random binary sequence, and the gate driver is configured to determine the scrambled scan sequence of the second gate line group according to a second pseudo-random binary sequence different from the first pseudo-random binary sequence.

4. The display apparatus as recited in claim 1, further comprising a random number table, wherein the gate driver is configured to determine the scrambled scan sequence according to the random number table.

5. The display apparatus as recited in claim 1, further comprising a first random number table and a second random number table, wherein the gate lines are at least categorized into a first gate line group and a second gate line group, the gate driver is configured to determine the scrambled scan sequence of the first gate line group according to the first random number table, and the gate driver is configured to determine the scrambled scan sequence of the second gate line group according to the second random number table different from the first random number table.

6. The display apparatus as recited in claim 1, further comprising a first random number table and a second random number table, wherein the gate driver is configured to determine the scrambled scan sequence in a first frame period according to the first random number table, and the gate driver is configured to determine the scrambled scan sequence in a second frame period according to the second random number table different from the first random number table.

7. The display apparatus as recited in claim 1, further comprising:

a timing controller, coupled to the gate driver, configured to obtain a detection result by detecting image data in a frame period, and control the gate driver to select a non-scrambled scan sequence or the scrambled scan sequence according to the detection result for driving the gate lines.

8. The display apparatus as recited in claim 1, further comprising:

a source driver, coupled to the display panel, configured to drive source lines of the display panel according to image data, wherein the gate driver selects the scrambled scan sequence to drive the gate lines if a temperature of the source driver is within a high-temperature range, and the gate driver selects a non-scrambled scan sequence to drive the gate lines if the temperature of the source driver is within a low-temperature range.

9. The display apparatus as recited in claim 1, further comprising:

a source driver, coupled to the display panel, configured to drive source lines of the display panel according to image data, wherein the gate driver selects the scrambled scan sequence to drive the gate lines if power consumption of the source driver is within a high-power range, and the gate driver selects a non-scrambled scan sequence to drive the gate lines if the power consumption of the source driver is within a low-power range.

10. A gate driving method adopted in a display apparatus, comprising:

providing a display panel;

determining a scrambled scan sequence in a first frame period by a gate driver according to a first pseudo-random binary sequence;

determining the scrambled scan sequence in a second frame period by the gate driver according to a second pseudo-random binary sequence different from the first pseudo-random binary sequence; and driving a plurality of gate lines of the display panel by the gate driver according to the scrambled scan sequence.

11. The gate driving method as recited in claim 10, further comprising:

determining the scrambled scan sequence by the gate driver according to a pseudo-random binary sequence.

12. The gate driving method as recited in claim 10, wherein the gate lines are at least categorized into a first gate line group and a second gate line group, and the gate driving method further comprises:

determining the scrambled scan sequence of the first gate line group by the gate driver according to a first pseudo-random binary sequence; and determining the scrambled scan sequence of the second gate line group by the gate driver according to a second pseudo-random binary sequence different from the first pseudo-random binary sequence.

13. The gate driving method as recited in claim 10, further comprising:

determining the scrambled scan sequence by the gate driver according to a random number table.

14. The gate driving method as recited in claim 10, wherein the gate lines are at least categorized into a first gate line group and a second gate line group, and the gate driving method further comprises:

determining the scrambled scan sequence of the first gate line group by the gate driver according to a first random number table; and determining the scrambled scan sequence of the second gate line group by the gate driver according to a second random number table different from the first random number table.

15. The gate driving method as recited in claim 10, further comprising:

determining the scrambled scan sequence in a first frame period by the gate driver according to a first random number table; and determining the scrambled scan sequence in a second frame period by the gate driver according to a second random number table different from the first random number table.

16. The gate driving method as recited in claim 10, further comprising:

obtaining a detection result by a timing controller detecting image data in a frame period; and selecting a non-scrambled scan sequence or the scrambled scan sequence according to the detection result for driving the gate lines.

17. The gate driving method as recited in claim 10, wherein the gate driver selects the scrambled scan sequence to drive the gate lines if a temperature of a source driver is within a high-temperature range, and the gate driver selects a non-scrambled scan sequence to drive the gate lines if the temperature of the source driver is within a low-temperature range.

18. The gate driving method as recited in claim 10, wherein the gate driver selects the scrambled scan sequence to drive the gate lines if power consumption of a source driver is within a high-power range, and the gate driver selects a non-scrambled scan sequence to drive the gate lines if the power consumption of the source driver is within a low-power range.

* * * * *